US005743651A

United States Patent [19]

Steinmetz

[11] Patent Number: 5,743,651

[45] Date of Patent: Apr. 28, 1998

[54] METHOD AND APPARATUS FOR FILLING TRASH BAGS

[76] Inventor: Floyd Steinmetz, R.R. 4, Box 4199, Moscow, Pa. 18444

[21] Appl. No.: 708,127

[22] Filed: Aug. 5, 1996

[51] Int. Cl.[6] ..... B65D 33/02

[52] U.S. Cl. ..... 383/33; 15/257.1; 248/98

[58] Field of Search ..... 383/33; 248/98; 215/257.1

[56] References Cited

U.S. PATENT DOCUMENTS

| | | |
|---|---|---|
| 1,228,333 | 5/1917 | McBurney . |
| 2,295,584 | 9/1942 | Larson . |
| 3,934,803 | 1/1976 | Paulus, Jr. . |
| 4,026,340 | 5/1977 | Sobolik . |
| 4,287,701 | 9/1981 | Washington . |
| 4,558,463 | 12/1985 | Boyd . |
| 4,664,348 | 5/1987 | Corsaut, III et al. . |
| 5,011,103 | 4/1991 | Hayes et al. . |
| 5,082,219 | 1/1992 | Blair . |
| 5,139,219 | 8/1992 | Navarro . |
| 5,183,339 | 2/1993 | Williams . |

*Primary Examiner*—Stephen P. Garbe

*Attorney, Agent, or Firm*—John F. A. Earley; John F. A. Earley, III

[57] ABSTRACT

A method and trash bag assembly for collecting fallen leaves, lawn clippings, and trash when doing yard work and filling a trash bag with such material.

5 Claims, 1 Drawing Sheet

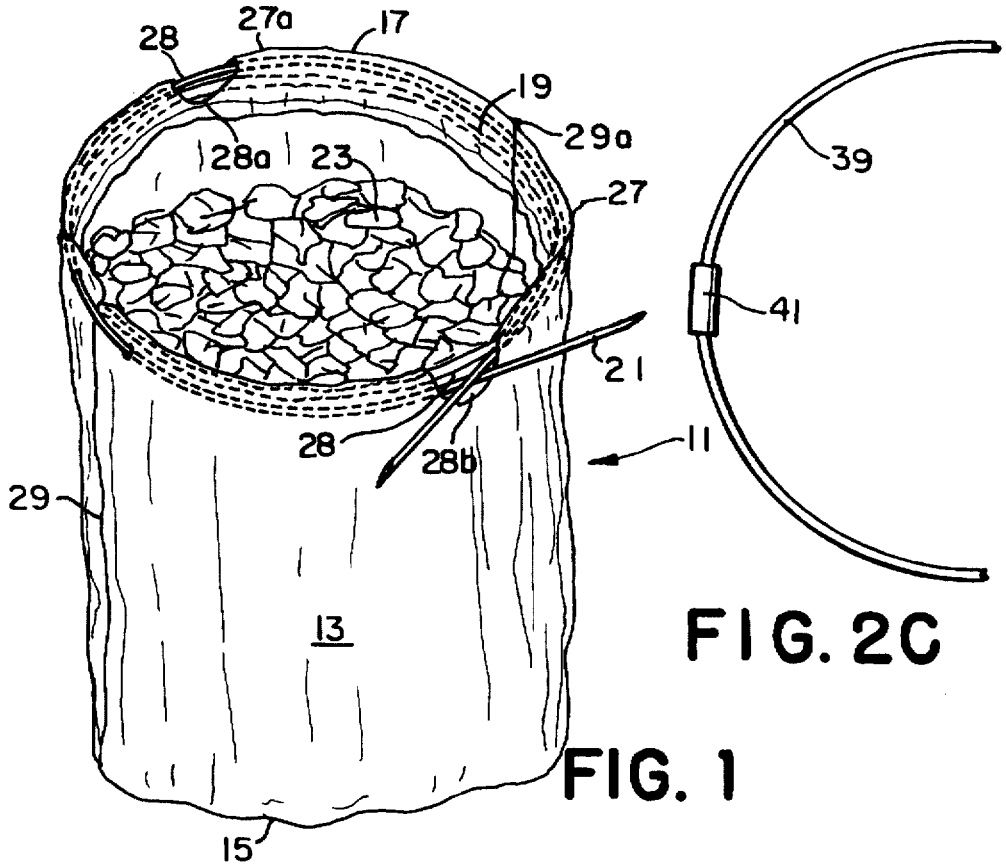
FIG. 2C
FIG. 1
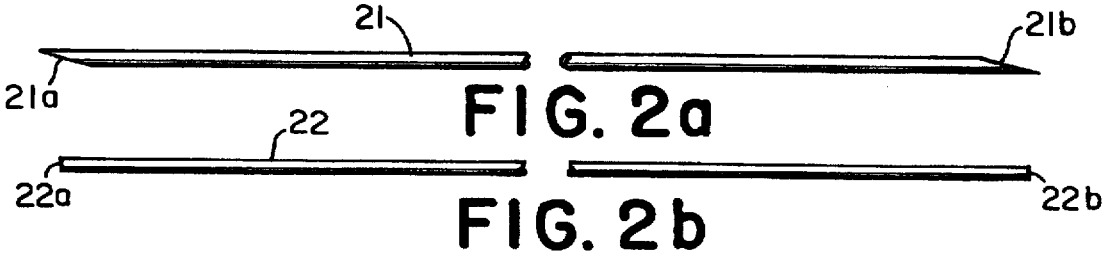
FIG. 2a
FIG. 2b
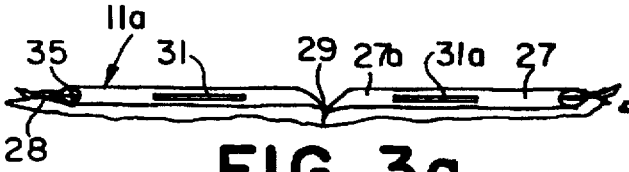
FIG. 3a
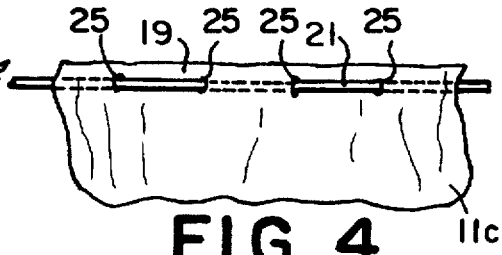
FIG 4
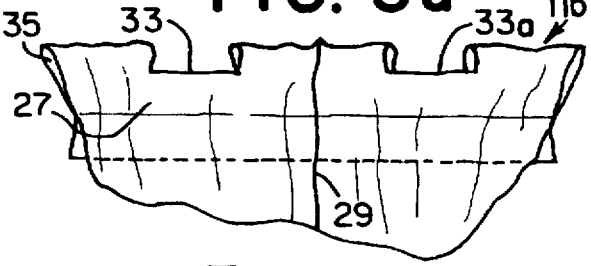
FIG. 3b
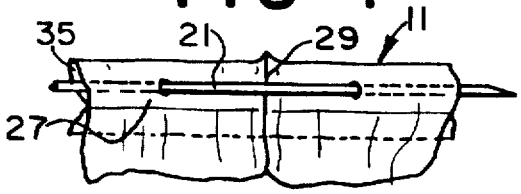
FIG. 3c

METHOD AND APPARATUS FOR FILLING TRASH BAGS

BACKGROUND OF THE INVENTION

1. Field of the Invention

This invention relates to doing yard work around the house and more particularly concerns a method and apparatus for collecting fallen leaves, lawn clippings, and trash when doing yard work and inserting such material into a trash bag which is fully open without anyone being required to stand there and hold it open.

2. Description of the Prior Art

Anyone who has done yard work around their home is familiar with plastic trash bags. These are generally made from film ranging from 0.5 to 1.2 mil thickness. The common types available differ somewhat in diameter and length but not by much. They are advertised as fitting into garbage cans up to thirty gallons, or thirty-three gallons, or thirty-nine gallons.

These bags are very handy and economical. The problem arises when it comes to filling them. An accepted technique is to place the open bag into a metal or plastic garbage can and fold the lip of the bag over the top edge of the can. This assumes that a can is available, the can is empty, and it is the correct shape to suit the bag.

Under ideal conditions, the bag in the can accepts leaves, grass clippings, pine needles, or whatever, without falling into the can with the trash. Once the bag is full, it must be lifted from the can. According to U.S. Pat. No. 4,558,463 which issued on Dec. 10, 1985 to Boyd, "The load in a trash bag may typically be as high as 30–50 lbs." Column 1, lines 21–22.

To lift that weight is in itself not easy, but to add to the difficulty the lower portion of the bag is swelling and gripping the can like a cork in a bottle. Now the can must be held down while the full bag is drawn out.

To fill a trash bag without using a can as an assist is also very difficult. It is almost impossible to lay a bag on the ground and arrange the opening to anywhere near its full extent. Bags having a hem top edge with a drawstring are somewhat better in this regard than bags with a simple sheared edge, but even the hemmed bags leave much to be desired.

SUMMARY OF THE INVENTION

My inventive method and apparatus is intended to alleviate the above problems. It includes a reusable flexible resilient rod which is placed into the top edge of a plastic bag at its open end. As the rod tries to straighten out, it stretches the bag opening into a circle which is approximately the maximum opening possible. When the bag is on the ground, and is wide open, an arm load of trash may be placed within this circle. The rod and the bag edge are then gripped on opposite sides and lifted. The trash drops to the bottom and the bag is ready for the next arm load of trash. When the bag is full, the rod is slipped out to be used again, and the bag is closed.

The rod may be made from one of many materials such a metal, plastic, or even wood. Synthetic plastic is probably the most economical since it may be extruded. There are many types of acceptable thermoplastic material from which to choose, for example, a polyethylene material.

The size in cross section of the rod and the stiffness of the rod may affect the ease of weaving the rod into the edge portion of the trash bag. If TEFLON plastic, a round cross section of about three sixteenth inch diameter works well. The length of the rod is not all that critical. It is convenient if the end portions of the rod overlap somewhat outside the bag when the rod is installed in the bag. This provides an end portion which may be gripped to pull the rod out of the bag once the bag is full. Since common sizes of trash bags are five feet or five and one half feet in circumference, a six foot rod length is convenient. However, longer or shorter is acceptable. The rod is helpful in filling the trash bags even if the rod is a little shorter than the bag circumference.

The rod ends may be cut off square to the length. However, cutting the ends of the rod on a bias to form a pointed end is a little more helpful when weaving the rod into the bag, and is the preferred embodiment.

There are two basic types of bag. Those with a drawstring have a hem with cutouts on opposite sides of the hem to give access to the drawstring. It is very convenient to slip the rod into a cutout and push it through the hem. However, the rod travels only 90 degrees around the bag because these bags have a vertical seam on both sides which runs from the bottom to the top of the bag. There are three ways to get the rod past the seam, and they are as follows.

First, you may insert the front end portion of the rod through a cutout into the interior of the hem and pierce the hem wall by pushing the rod from inside of the hem through the outside wall of the hem just before the seam, and return the rod into the inside of the hem just past the seam by piercing the outside hem wall with the rod from outside the hem. This procedure is repeated for the second seam and the rod travels inside the hem until the rod exits through the cutout where it first entered.

Second, using a knife, you may slit the top of the hem for an inch plus/minus on both sides of the seams. The rod is then easily passed out one slit, over the seam, and then returned through the next slit.

Third, using scissors, cut away the top edge of the hem for about an inch on both sides of the seam. This is by far the most convenient passage for the rod out of one slot, pass over the seam, and return through the next slot to the inside of the hem. Bag manufacturers may provide this cutout at the same time the drawstring cutout is made.

The remaining types of trash bags have various closure techniques. However, they have the common feature of having no hem. Therefore, to install a rod, it is necessary to pierce the bag wall with the end of the rod. This is done with an in and out weaving action all along the bag circumference. Location of the rod from the bag top edge and the spacing of the pierced holes are not critical. The rod may preferably be one to three inches below the bag edge, and the pierced holes may be six to eight inches apart.

DESCRIPTION OF THE DRAWINGS

FIG. 1 is a view in perspective of bag apparatus constructed in accordance with this invention and shows a bag with its top end held fully open by a resilient rod and with the bag being partly filled with leaves;

FIG. 2*a* is a view of a rod having tapered ends which is the preferred embodiment of rod;

FIG. 2*b* is a view of a rod having square ends;

FIG. 2*c* is a view of a rod being made into a circular shape;

FIG. 3*a* is a partial view in top plan of a portion of a perimeter of a bag and shows slits in the top fold line of the bag before and after a vertical seam;

FIG. 3*b* shows a partial view in elevation of the top of a bag having cut out portions or slots cut into the top perimeter of the bag before and after a vertical seam;

FIG. 3c is a partial view in elevation of a bag having a rod which is piercing a hole in the outside wall of a hem both before and after a vertical seam, with the drawstring being omitted for clarity; and FIG. 4 is a partial view in elevation of a bag without a hem and without drawstrings and shows a rod which has pierced the top portion of a bag in and out in a weaving fashion.

DETAILED DESCRIPTION OF THE DRAWINGS

Turning now to the drawings, there is shown a trash bag 11 which has a body portion 13, a bottom portion 15 which is closed, and a top end portion 17 which is open and has a top perimeter portion 19. An opener rod 21 which is flexible and resilient is provide for opening and holding open the open end 17 of the trash bag while it is being filled with trash material such as fallen leaves, lawn clippings, and other trash. The flexible resilient rod 21 is inserted through the top perimeter portion 19 of the trash bag 11 for expanding the top perimeter portion 19 to make it circular and for holding the top perimeter portion 19 in circular position so that the bag 11 is fully open to receive such trash material without requiring anyone to hold the bag open.

The rod 21 is shown in FIG. 2a and is provided with pointed or tapered ends 21a and 21b for easier insertion of the rod through the top perimeter portion 19. However, a flexible resilient rod 22 having square ends 22a and 22b may be used in the practice of this invention if desired.

The method of collecting trash material such as fallen leaves, lawn clippings, and other trash when doing yard work comprises the steps of taking a trash bag 11 having body portion 13, a closed end bottom portion 15, and an open end top portion 17 with a top perimeter portion 19, inserting the flexible resilient rod 21 through the top perimeter portion 19 to expand the top perimeter portion 19 into a circular position and fully open the top perimeter portion 19 of the bag 11, holding the perimeter portion 19 of the bag 11 fully open in circular position by leaving the flexible resilient rod 21 in the top perimeter portion 19, placing the bag on the ground with the fully opened top perimeter portion 19 facing up, placing an arm load of fallen leaves, lawn clippings, or other trash into the fully open top perimeter portion 19, gripping the rod 21 and the top perimeter portion 19 on opposite sides of the bag and lifting them above the level of the load of leaves, lawn clippings, or other trash, so that said trash material drops to the bottom of the bag 11 to ready the bag for the next load of trash, filling the bag 11 with said trash by repeating the placing step and the gripping step until the bag 11 is filled, slipping the rod 21 out of the top perimeter portion 19 to be used again, and closing the top portion 17 of the bag by pulling the drawstrings 28 at drawstring openings 28a, 28b.

As shown in FIG. 1, the rod 21 is longer than the top perimeter portion 19 of the bag 11, and the rod 21 is inserted through top perimeter portion 19 so that the ends 21a, 21b of the rod 21 emerge from drawstring opening 28b and overlap outside the top perimeter portion 19. The rod 21 is slipped out of the top perimeter portion 19 by grasping one end of the rod 21 and pulling on it.

The rod 21 may be used with a number of different bags. Bag 11 is provided with a hem 27 and drawstrings 28 having two drawstring openings 28a, 28b about 180 degrees apart. After the rod 21 has been removed from the bag, the drawstrings 28 are pulled to close the top of the bag.

Bag 11 has vertical seams 29, 29a which extend from the top 17 of the bag to bottom 15, and a hem 27. The rod 21 is inserted through the hem 27 and avoids the seams 29, 29a by piercing the outer skin of the bag before and after the seam, pushing outwardly through the outer hem wall before the seams 29, 29a and pushing inwardly through the outer hem wall into the hem 27 after passing the seams 29, 29a.

FIG. 3a is a partial view in top plan and shows a similar bag 11a having a hem 27 with a tunnel 35 and a drawstring 28, but instead of piercing the side wall of the hem 27 with the rod 21, the bag 11a is provided with a slit 31 in the top fold line 27a of the hem 27 just before the vertical seam 29, and a slit 31a just after the vertical seam 29.

FIG. 3b shows an alternative bag 11b with a hem 27 and is provided with a cutout portion 33 in the top of the hem 27 just before the vertical seam 29, and a cutout portion 33a just after the vertical seam 29 in the hem 27. In this embodiment of the invention, the rod 21 passes through the tunnel 35 of hem 27 and out of the hem through the cutout portion 33 and returns to the tunnel 35 of the hem 27 after passing the vertical seam 29 through cutout portion 33a of hem 27.

FIG. 3c is an enlarged partial view of bag 11 showing the rod 21 as it passes through the hem 27 around the vertical seam 29. In the view of FIG. 3c, the drawstring 28 has been omitted for the sake of clarity.

FIG. 4 shows an enlarged partial view of another bag 11c which has no hem and shows the piercing of holes 25 around the top perimeter portion 19 of the bag 11c with an in and out weaving action to attach the rod 21 to the top perimeter portion 19.

The original rod 21 used in this invention was a 3/16 inch diameter rod of very flexible TEFLON synthetic resin.

TEFLON is a trademark of E.I. Dupont de Numours & Co., 1007 Market Street, Wilmington, Del. 19898 for its synthetic resinous fluorine, containing polymers in the form of molding and extruding compositions, fabricated shapes: namely, sheets, rods, tubes, tape and filaments; solutions; and emulsions.

The original TEFLON rod 21 performed well in all respects. However, I thought it might feel better to the workman in picking up the bag edge with the rod 21 woven therein if the rod were just a little thicker. Therefore, I obtained rods of ¼ inch diameter in the following thermoplastic materials. These are listed in order of decreasing hardness which also denotes decreasing stiffness: Polycarbonate, Nylon, Delrin, PVC Type I, ABS, High Density Polyethylene, High Impact Polystyrene, Polypropylene, Low Density Polyethylene.

Surprisingly, I very quickly learned that none of these rods could be used as received. The ¼ inch diameter nylon rod was almost impossible to weave into the edge of a trash bag. When it was finally accomplished, it formed a bag opening which had a narrow tear drop shape instead of the desired fully open circular shape.

The low density polyethylene rod was much easier to weave into the bag, but it also created a tear drop shaped opening, which was somewhat wider than the bag with the nylon rod, but still nowhere near a circular shape.

In my opinion, there are two reasons for the difference of the behavior of the ¼ inch rods as compared to the behavior of the original 3/16 inch diameter TEFLON rod.

First, material stiffness.

Second, thickness of the rod. Changing from 3/16 inch diameter to ¼ inch diameter does not appear to be too great a change. However, the result was that the ¼ inch rod was almost impossible to weave into the edge portion of the trash bag, and when it formed the bag opening, the bag opening was a narrow tear drop shape instead of the desired fully opened circular shape. This result was surprising.

A possible explanation of why this surprising result occurs might be as follows. The deflection of a beam in bending is a function of the Moment of Inertia (I) of the beam cross section. In the present invention, the cross sections are circular, and the Moment of Inertia (I)=0.049 times diameter to the fourth power. Therefore:

For 3/16 diameter I=0.000061

For ¼ diameter I=0.000191

Or a ¼ diameter rod is 3.13 times stiffer than a 3/16 inch diameter rod.

In conclusion, none of the ¼ diameter rods function properly when in straight rod form. However, when thermoformed into circular shape, the ¼ inch diameter rods worked very well. To do this, I formed a ¼ inch rod into a circle by inserting the ends of a ¼ inch rod 39 into a metal tube 41 which retained the circular shape, and heated the rod 39 and tube 41 in an oven at about 235 degrees Fahrenheit for about two hours. Tube 41 was a six inches long tube made of copper with an inside diameter of ½ inch.

The rod 39 was preformed into a circle of a diameter approximately equal to the diameter of the opening of an average trash bag.

I claim:

1. A trash bag assembly for doing yard work for opening and holding open the open end (17) of the trash bag (11) while it is being filled with fallen leaves, lawn clippings, and other trash, comprising a trash bag (11) for doing yard work having a body portion (13), a closed end bottom (15), and an open end top portion (17) with a top perimeter portion (19), and means (21) for opening the trash bag by expanding the top perimeter portion (19) to a circular position and for holding the top perimeter (19) in circular position so that the bag (11) is fully open to receive fallen leaves, lawn clippings, and other trash without requiring someone to hold the bag open said means for opening the trash bag and holding it open being insertable after manufacture of the trash bag, being a flexible resilient rod removable from the trash bag, and being reusable on other trash bags indefinitely, said rod having two ends which are free and unattached and not attached to each other so that either end of the rod can be inserted into the trash bag and the rod can be removed from the trash bag by pulling on either end, said rod being round in cross section, said rod being made of a synthetic resin plastic, and a closure on the bag for closing the bag after it has been filled and the rod removed.

2. The trash bag assembly of claim 1, said rod (21) having pointed ends (21*a*, 21*b*) for easier insertion through the top perimeter portion (19) of a trash bag.

3. The trash bag assembly of claim 1, the rod being 3/16 of an inch in cross section.

4. The trash bag assembly of claim 1, said rod being circular in shape before the insertion of the rod into the top perimeter portion of the trash bag and being circular in shape after the rod is inserted into the top perimeter portion of the trash bag.

5. The trash bag assembly of claim 1, the rod being ¼ inch in diameter in cross section diameter, the rod being made of nylon.

* * * * *